US010589551B2

(12) United States Patent
Nakazawa et al.

(10) Patent No.: US 10,589,551 B2
(45) Date of Patent: Mar. 17, 2020

(54) RECORDING APPARATUS

(71) Applicant: SEIKO EPSON CORPORATION, Tokyo (JP)

(72) Inventors: Akira Nakazawa, Azumino (JP); Toshihiro Imae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/815,183

(22) Filed: Nov. 16, 2017

(65) Prior Publication Data

US 2018/0141355 A1 May 24, 2018

(30) Foreign Application Priority Data

Nov. 22, 2016 (JP) ..... 2016-226676

(51) Int. Cl.

| | |
|---|---|
| ***B65H 27/00*** | (2006.01) |
| ***B41J 29/10*** | (2006.01) |
| ***B41J 29/13*** | (2006.01) |
| ***B65H 7/00*** | (2006.01) |
| *B41J 11/00* | (2006.01) |
| *B65H 20/02* | (2006.01) |

(52) U.S. Cl.

CPC ..... *B41J 29/10* (2013.01); *B41J 29/13* (2013.01); *B65H 7/00* (2013.01); *B41J 11/0045* (2013.01); *B65H 20/02* (2013.01); *B65H 27/00* (2013.01); *B65H 2515/82* (2013.01); *B65H 2601/521* (2013.01)

(58) Field of Classification Search

CPC ..... B41J 29/10; B65H 5/062; B65H 2301/16; B65H 2301/332; B65H 2301/333; B65H 2301/4211; B65H 2404/651; B65H 29/58; B65H 29/60; B65H 31/00

See application file for complete search history.

(56) References Cited

U.S. PATENT DOCUMENTS

| | | | | |
|---|---|---|---|---|
| 2004/0175210 A1* | 9/2004 | Otaka | ..... | B65H 5/062 399/318 |
| 2009/0026691 A1* | 1/2009 | Ishikawa | ..... | B65H 5/062 271/10.12 |

FOREIGN PATENT DOCUMENTS

| | | |
|---|---|---|
| JP | 10-007288 | 1/1998 |
| JP | 2009-040565 | 2/2009 |
| JP | 2009-083957 | 4/2009 |
| JP | 2009-226833 | 10/2009 |

* cited by examiner

*Primary Examiner* — Thomas A Morrison
(74) *Attorney, Agent, or Firm* — Workman Nydegger

(57) ABSTRACT

A printer includes an apparatus body having a recording head for performing recording onto a sheet of paper. The printer also includes a unit body that is accommodated inside the apparatus body and has a path-forming surface formed at least on a portion of the periphery of the unit body. The path-forming surface forms a medium transport path. The unit body includes a plurality of openings that are in communication with a sound absorber disposed inside the unit body. The plurality of the openings are provided at least on a portion of the path-forming surface.

12 Claims, 12 Drawing Sheets

RECORDING APPARATUS

INCORPORATED BY REFERENCE

The entire disclosure of Japanese Patent Application No. 2016-226676, filed Nov. 22, 2016 is expressly incorporated by reference herein.

BACKGROUND

1. Technical Field

The present disclosure relates to a recording apparatus for performing recording onto a transported medium.

2. Related Art

A recording apparatus, of which an ink jet printer is a representative example, is equipped with a transport path for transporting a sheet of recording paper, which serves as a medium, and an inversion path provided in the transport path for inverting the sheet. Thus, such a recording apparatuses can perform recording on both sides of the sheet.

In such a recording apparatus, noises are generated in the apparatus body by operating a driving system that includes medium transport devices, etc., and a driving source for the driving system. A transported medium also generates a rustling sound or noise when the medium rubs against guide surfaces of the transport path. Thus, a recording apparatus may include a sound absorber provided near the transport path so as to absorb the sound and reduce the noise level (see, for example, JP-A-10-7288, JP-A-2009-83957, and JP-A-2009-40565).

In JP-A-10-7288, JP-A-2009-83957, and JP-A-2009-40565, a configuration is disclosed in which the sound absorber is provided along the transport path, and path parts constituting the transport path have openings for improving the sound absorption effect of the sound absorber. However, in the known configuration disclosed in JP-A-10-7288, JP-A-2009-83957, and JP-A-2009-40565, the path parts having openings are disposed at positions closer to the outside of the apparatus body with respect to the transport path. Thus, the sound passing through the openings may escape from the apparatus body. There has been a case in which due to the provision of the openings, an increase in the volume of the sound escaping from the openings is considered a trade-off for further improvement in the sound absorption effect of the sound absorber.

SUMMARY

An advantage of some aspects of the disclosure is that the escape of sounds generated inside a recording apparatus from the apparatus body is suppressed or reduced.

A recording apparatus according to an aspect of the disclosure includes an apparatus body having a recording device that performs recording onto a medium; a unit body that is accommodated inside the apparatus body and has a path-forming surface formed at least on a portion of a periphery of the unit body, the path-forming surface forming a medium transport path; and a sound absorber disposed inside the unit body. In addition, the unit body further includes a plurality of openings that are in communication with the sound absorber inside the unit body, and the plurality of the openings are provided at least on a portion of the path-forming surface.

According to this configuration, a unit body is accommodated inside the apparatus body and has a path-forming surface formed at least on a portion of a periphery of the unit body, and the path-forming surface forms a medium transport path. The unit body in which a sound absorber is disposed further includes a plurality of openings that are in communication with the sound absorber inside the unit body, and the plurality of the openings are provided at least on a portion of the path-forming surface. Thus, the recording apparatus can be formed such that the sound absorber provided inside the unit body absorbs sound generated around the unit body and the sound does not easily escape from the apparatus body.

It is preferable that in the recording apparatus, the sound absorber be disposed at a position inside the unit body corresponding to positions at which the openings are formed.

According to this configuration, the sound absorber is disposed at a position inside the unit body corresponding to positions at which the openings are formed. As a result, the sound absorption effect of the sound absorber can be obtained efficiently.

It is preferable that in the recording apparatus, the openings be covered with the sound absorber from inside the unit body.

According to this configuration, the openings are covered with the sound absorber from inside the unit body. As a result, the sound absorption effect of the sound absorber can be obtained more efficiently.

It is preferable in the recording apparatus that the path-forming surface include a first path-forming surface that forms a feed path on which the medium is transported from a setting device at which the medium is set toward a recording region of the recording device; and a second path-forming surface that forms a switchback path on which, when the medium onto which the recording device has performed recording is inverted, the medium is switched back from the recording region and transported into the feed path. In addition, it is also preferable that the openings be disposed at least on the first path-forming surface.

When a medium is transported on the medium transport path, the medium comes into contact with the medium transport path, which may generate sound (hereinafter referred to as a "rustling sound"). Such a rustling sound tends to occur when a dry medium before recording is transported. According to this configuration, the openings are disposed at least on the first path-forming surface that forms a feed path on which the medium is transported from a setting device at which the medium is set toward a recording region of the recording device. Thus, the rustling sound on the feed path can be reduced. In particular, the rustling sound generated when the medium before recording is transported can be effectively reduced.

It is preferable that in the recording apparatus, the apparatus body include an insertion device, which is different from the setting device, being capable of inserting the medium into a path region on the first path-forming surface on the feed path, and that the openings be at least disposed at positions near the insertion device on the first path-forming surface.

In the apparatus body, the sound inside the apparatus body tends to escape from the insertion device. According to this configuration, the openings are at least disposed at positions near the insertion device on the first path-forming surface. This can effectively reduce the sound escaping from the insertion device.

It is preferable that in the recording apparatus, the sound absorber be disposed on a back side of the second path-forming surface.

According to this configuration, the sound absorber is disposed on the back side of the second path-forming surface. Thus, the rustling sound of the medium can be reduced when the medium is transported on the feed path or on the switchback path.

It is preferable that in the recording apparatus, the openings are disposed on both the first path-forming surface and the second path-forming surface.

According to this configuration, the openings are disposed on both the first path-forming surface and the second path-forming surface. Thus, the rustling sound of the medium can be effectively reduced on both the feed path and the switchback path.

It is preferable that the recording apparatus further include transport devices that are provided in the medium transport path and that transport the medium; that at least one of the transport devices be formed so as to have an apparatus-side transport roller disposed at a position facing the unit body within the apparatus body and to have a unit body-side transport roller disposed in the unit body; that the unit body have a bearing therein that supports a rotating shaft of the unit body-side transport roller; and that the openings be disposed at positions away from a position at which the bearing is disposed in a direction in which the rotating shaft extends.

When the rotating shaft of the unit body-side transport roller rotates, the bearing may produce sliding sound in conjunction with the rotation of the rotation shaft. According to this configuration, in the unit body, the openings are disposed at positions away from a position at which the bearing is disposed in a direction in which the rotating shaft extends. In other words, the openings are not provided at the positions that correspond to the position of the bearing on the path-forming surface. This reduces the likelihood of the sliding sound of the bearing escaping from the unit body and enables the sound absorber provided inside the unit body to absorb the sliding sound.

It is preferable that in the recording apparatus, the unit body-side transport roller be exposed on both the feed path and the switchback path.

According to this configuration, the unit body-side transport roller can be utilized as a common transport device for the feed path and the switchback path, which can reduce the number of parts.

It is preferable in the recording apparatus that the unit body be capable of being attached to, and detached from, the apparatus body; that the apparatus body include an opening/closing body that opens/closes an accommodation space in which the unit body is accommodated, the opening/closing body having a path-forming wall and forming, in a closed state of the opening/closing body, a portion of the feed path on the path-forming wall and a portion of an exterior of the apparatus body; that the apparatus body further include an opening/closing-body sound absorber disposed on a back side of the path-forming wall; and that the path-forming wall be formed so as to have a continuous surface without openings.

In the description of this configuration, the "openings" mean apertures provided for the purpose of improving the sound absorption effect of the opening/closing-body sound absorber, in other words, apertures for the same noise reduction purpose as for the openings provided in the unit body. Thus, the openings do not include apertures for purposes other than the noise reduction, such as screw holes.

According to this configuration, the opening/closing-body sound absorber absorbs the sound generated inside the apparatus body and further reduces the sound escaping from the apparatus body. In this case, the path-forming wall is formed so as to have a continuous surface, which reduces the likelihood of the sound generated inside the apparatus body escaping therefrom.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
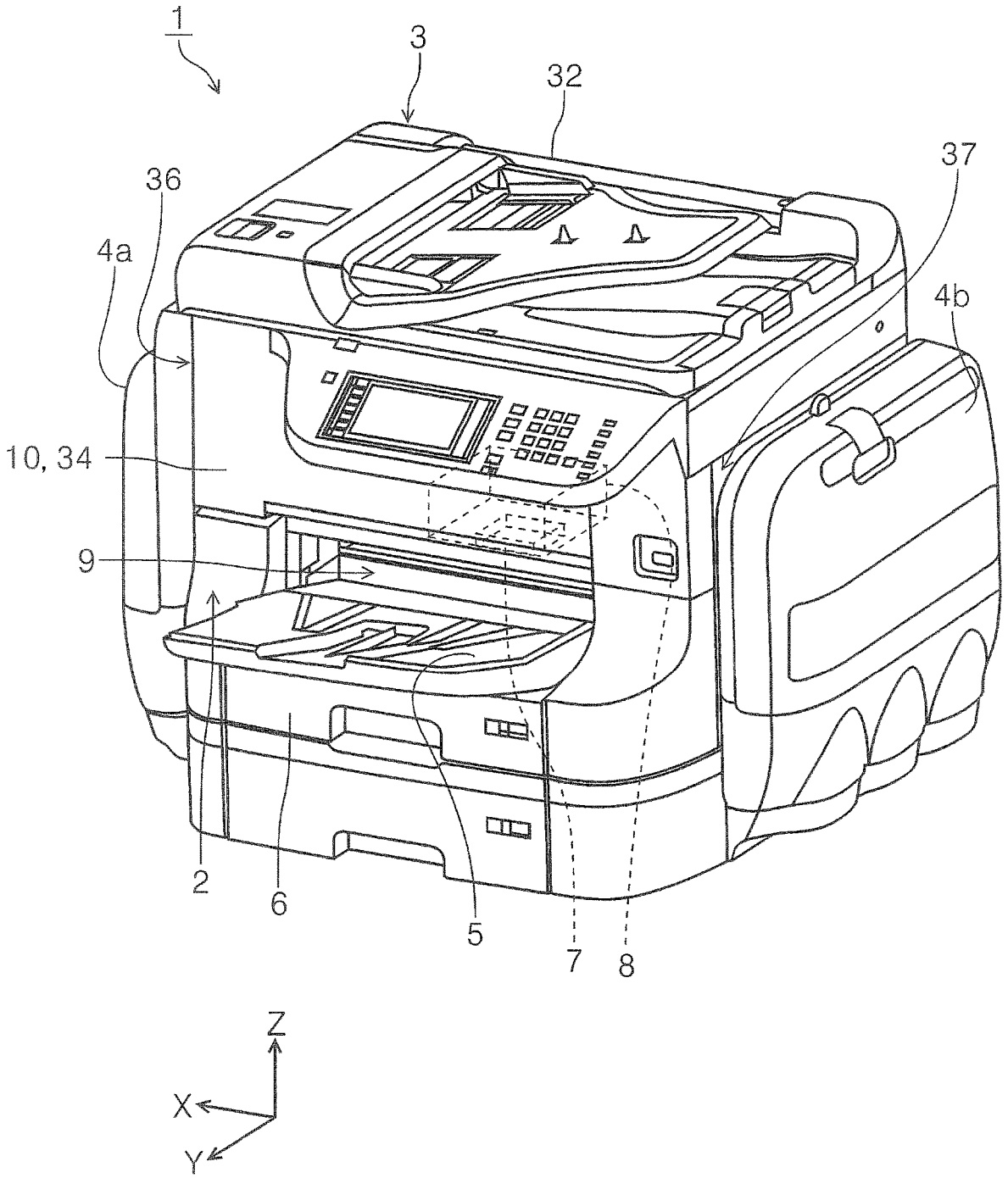
FIG. 1 is a perspective view illustrating the exterior of an example of a printer according to the disclosure.
Figure 2:
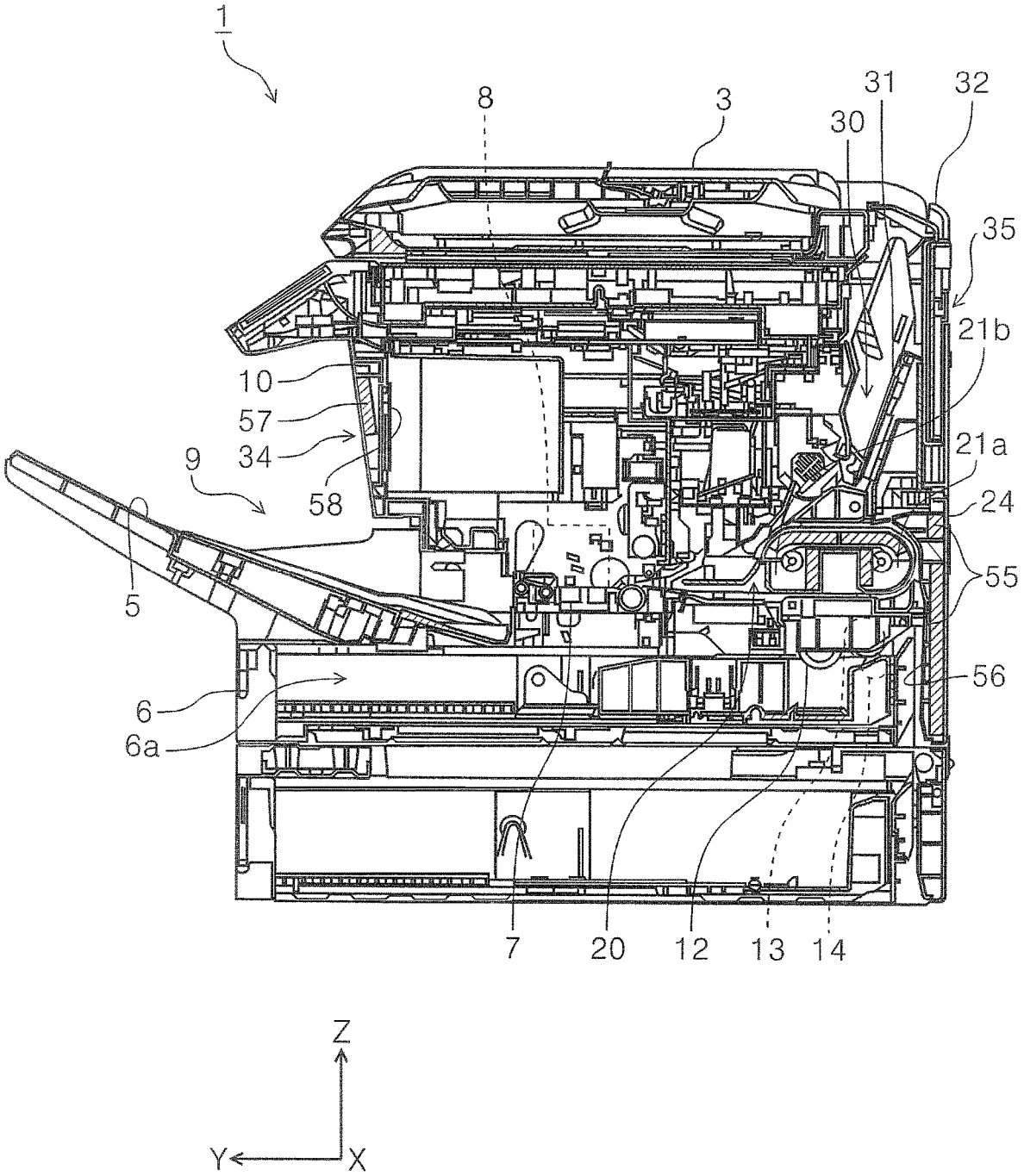
FIG. 2 is a cross-sectional side view illustrating the printer in FIG. 1.
Figure 3:
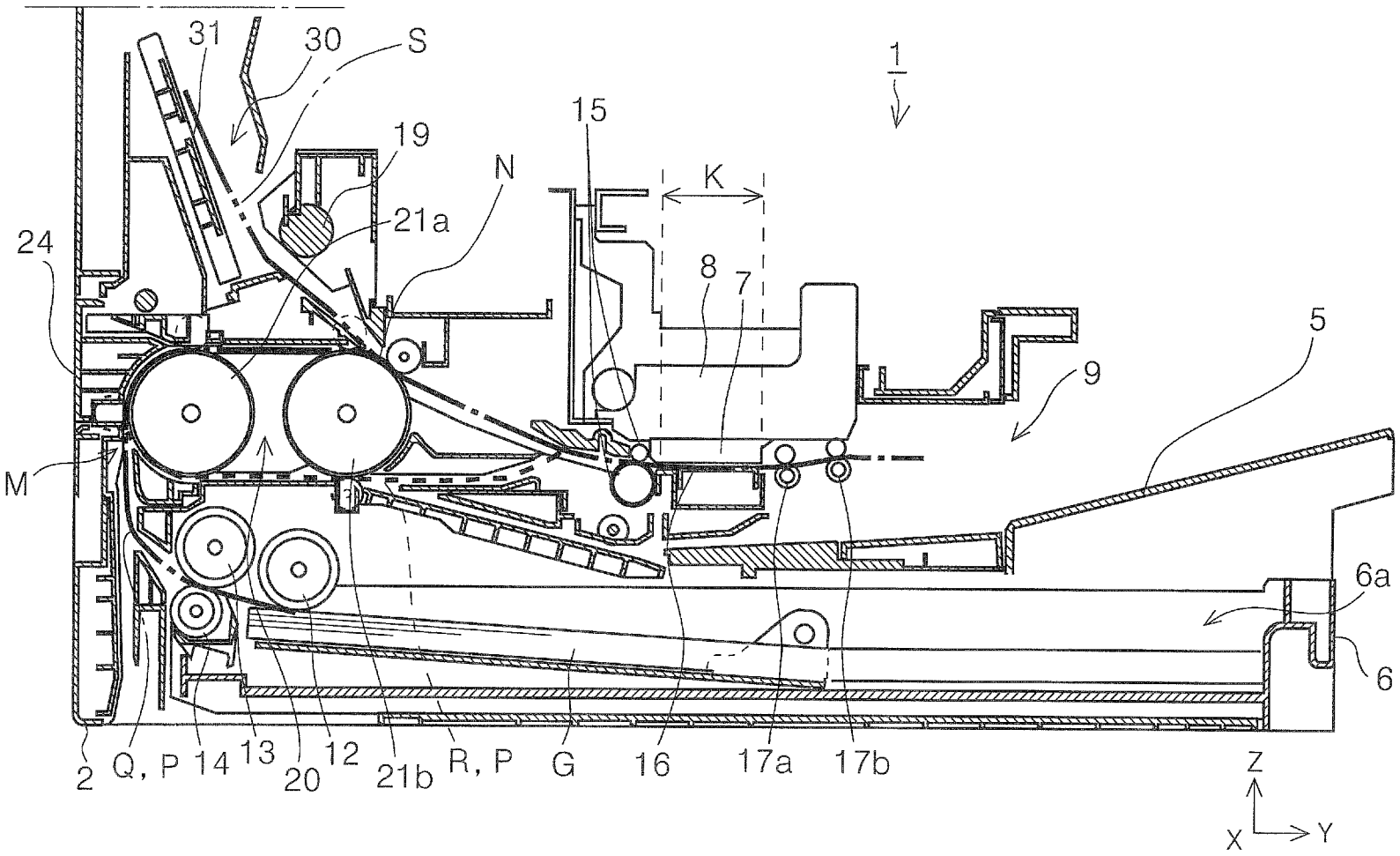
FIG. 3 is a cross-sectional side view illustrating a sheet transport path of the printer.
Figure 4:
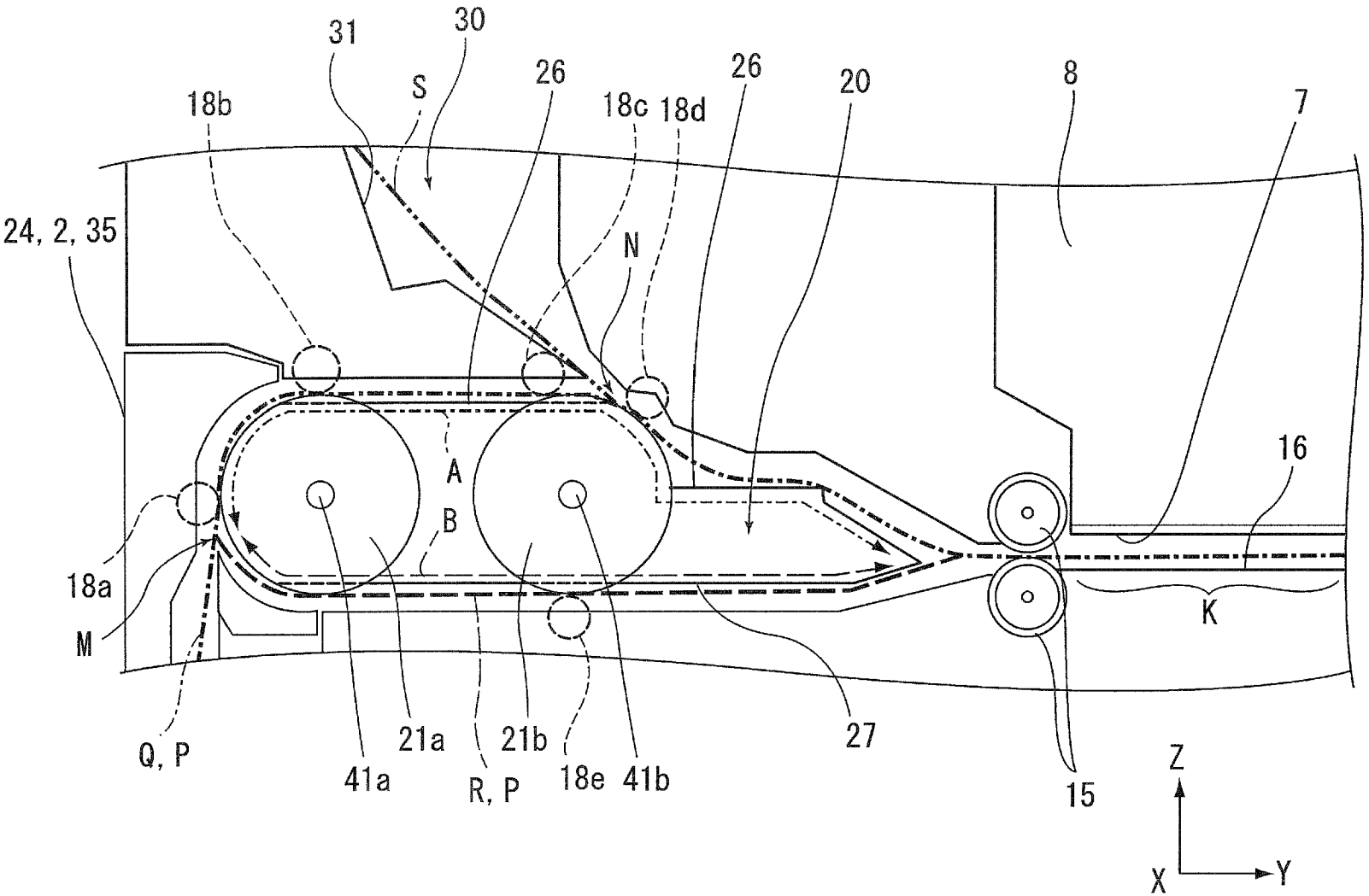
FIG. 4 is a diagram illustrating a feed path and an inversion path.
Figure 5:
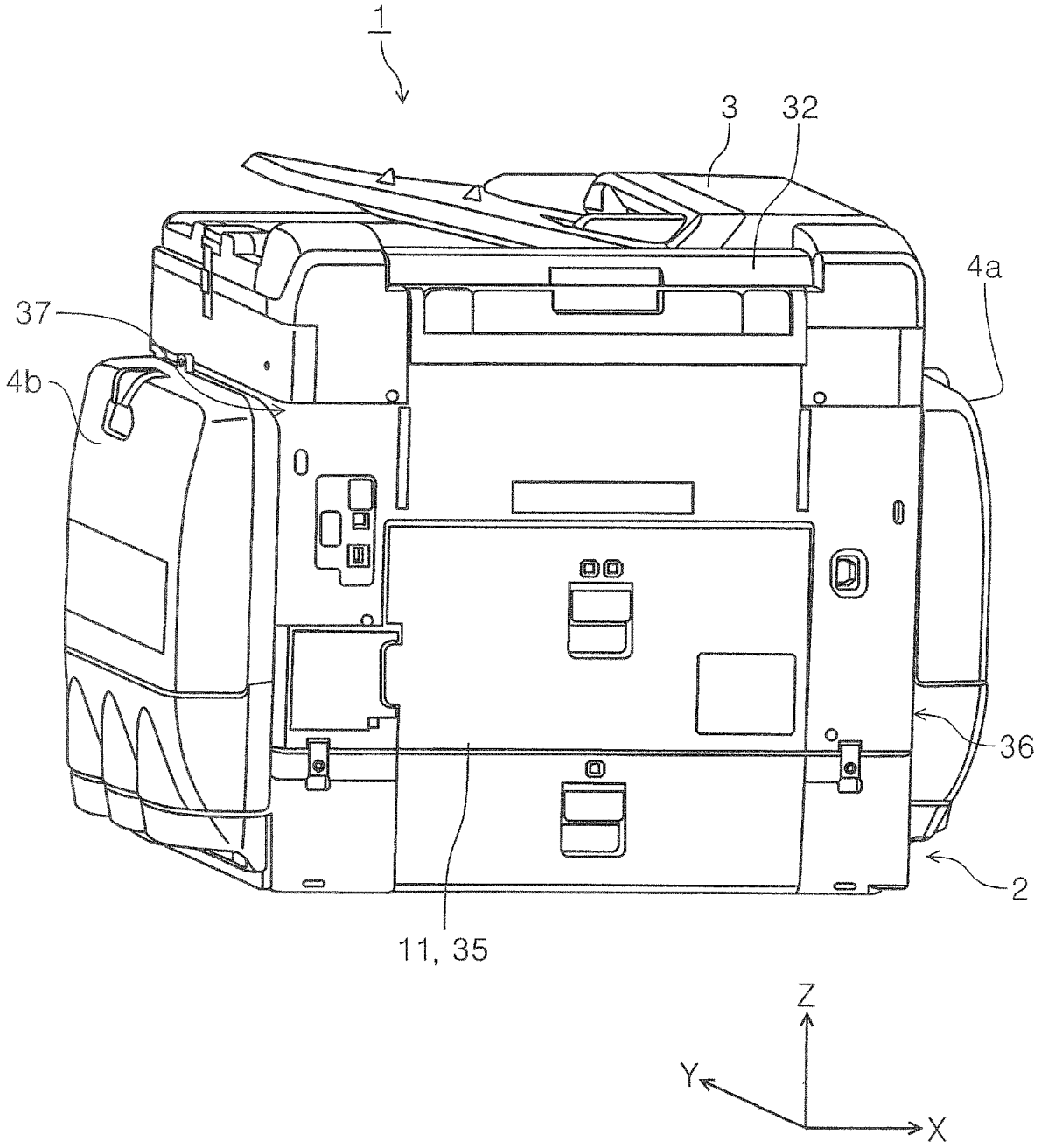
FIG. 5 is a perspective view illustrating the exterior of the printer in FIG. 1 when viewed from behind the printer.
Figure 6:
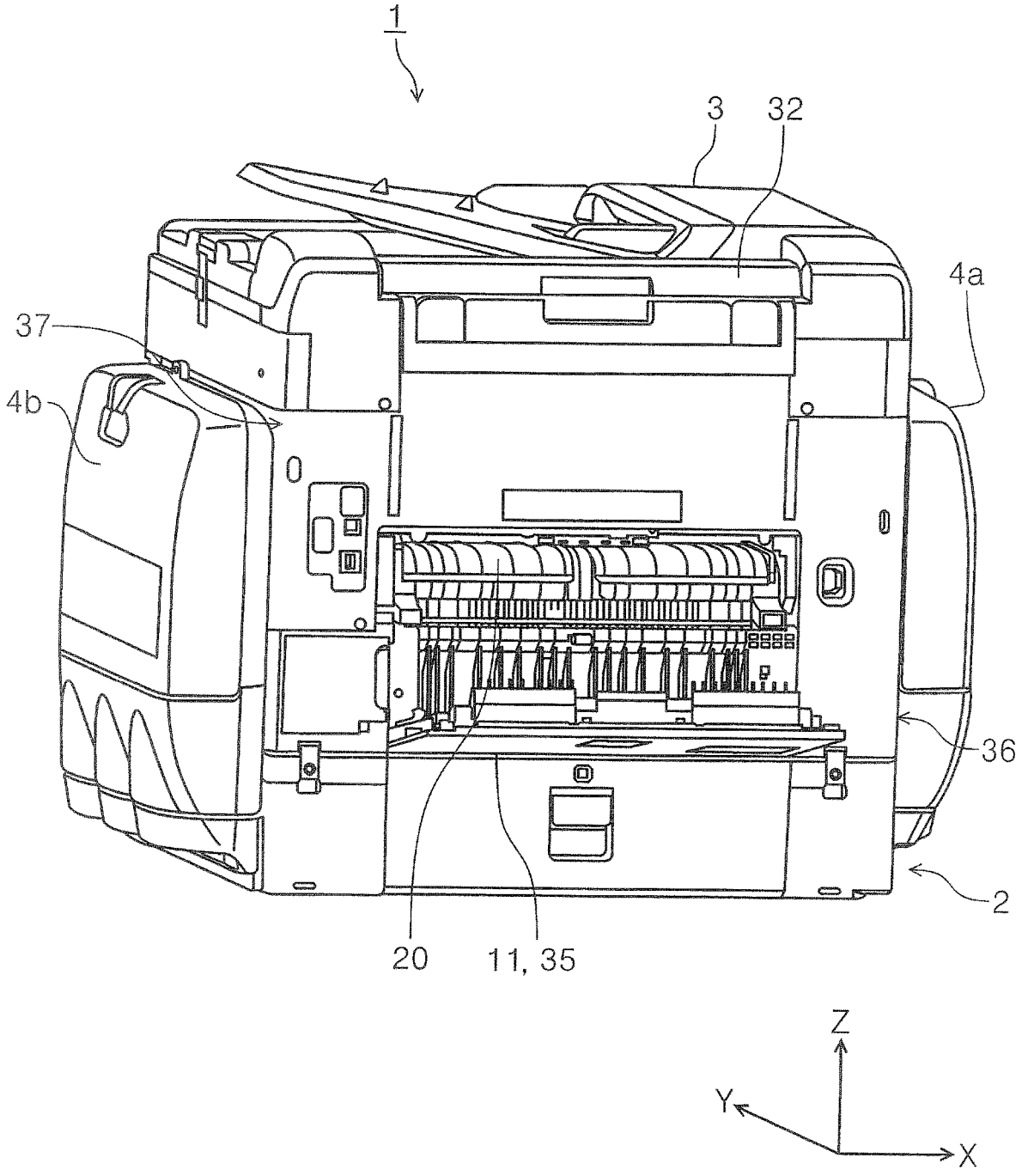
FIG. 6 is a view illustrating a state in which a rear-side cover of the printer in FIG. 5 is open.

A recording apparatus according to one embodiment of the disclosure will be outlined first. In the present embodiment, an ink jet printer 1 (hereinafter simply referred to as a "printer 1") will be described as an example of the recording apparatus. FIG. 1 is a perspective view illustrating the exterior of an example of a printer according to the disclosure. FIG. 2 is a cross-sectional side view illustrating the printer in FIG. 1. FIG. 3 is a cross-sectional side view illustrating a sheet transport path of the printer. FIG. 4 is a diagram illustrating a feed path and an inversion path. FIG. 5 is a perspective view illustrating the exterior of the printer in FIG. 1 when viewed from behind the printer. FIG. 6 is a view illustrating a state in which a rear-side cover of the printer in FIG. 5 is open.

Figure 7:
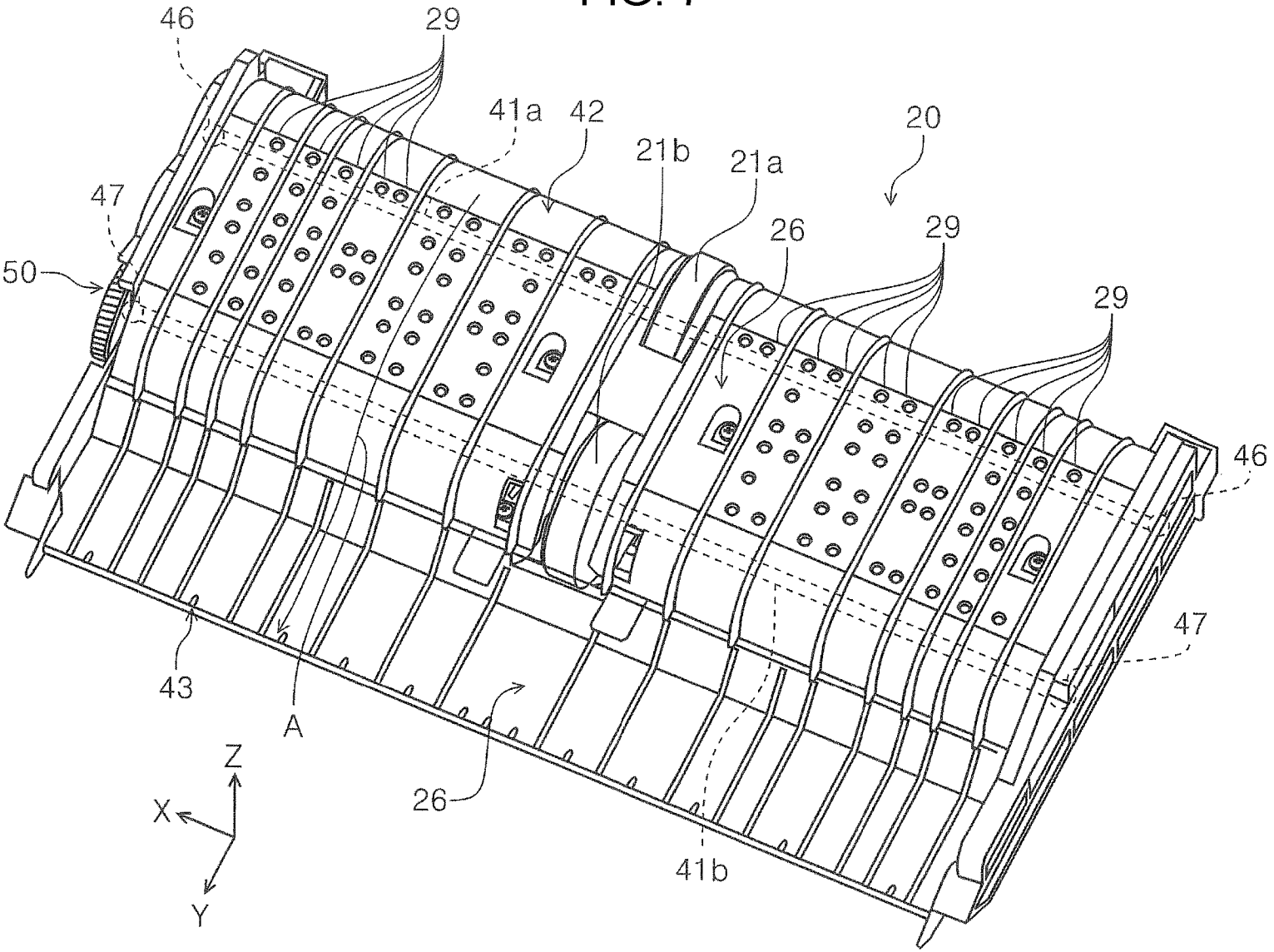
FIG. 7 is a perspective view illustrating the exterior of a unit body.
Figure 8:
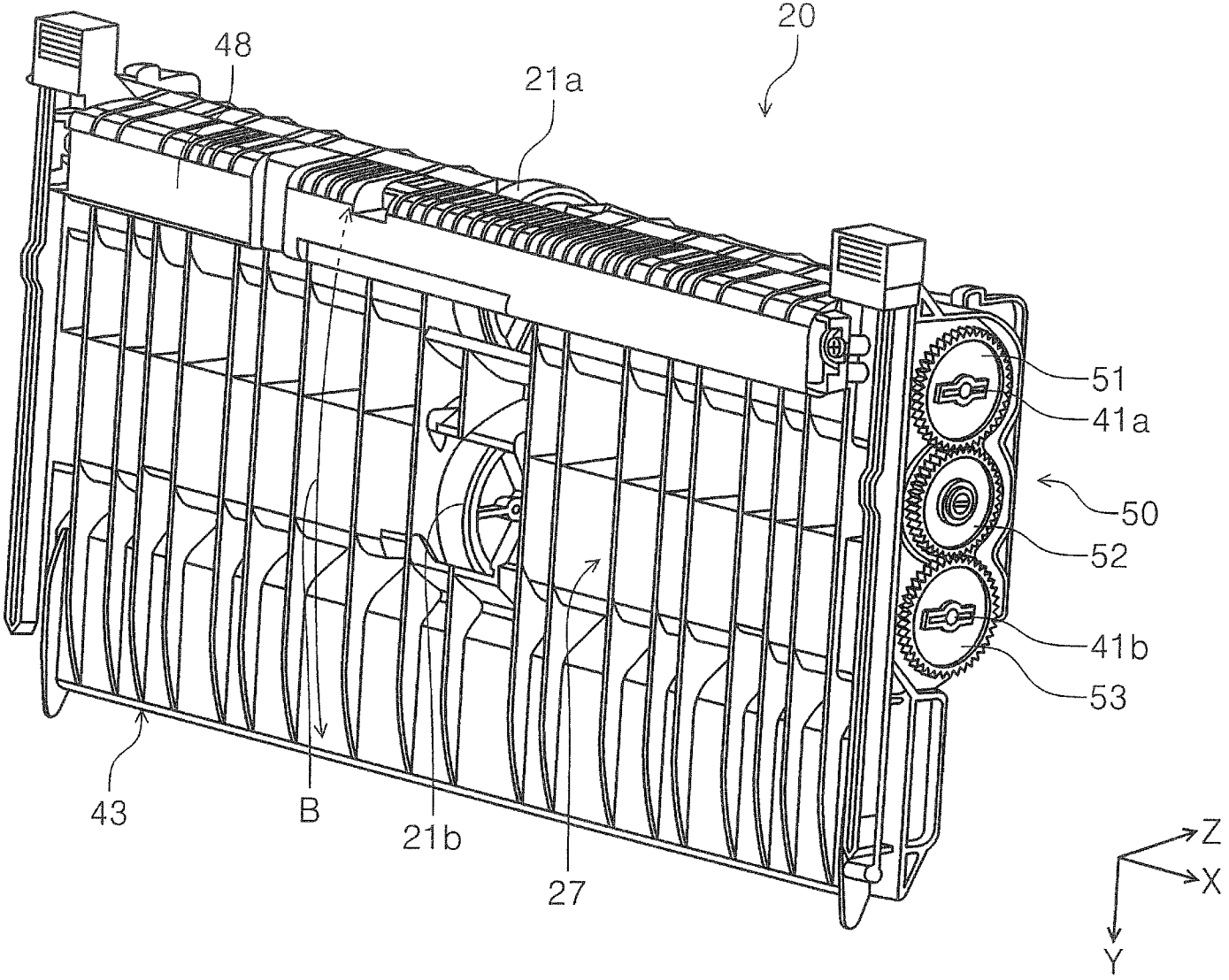
FIG. 8 is a perspective view illustrating the unit body in FIG. 7 when viewed from a different angle.
Figure 9:
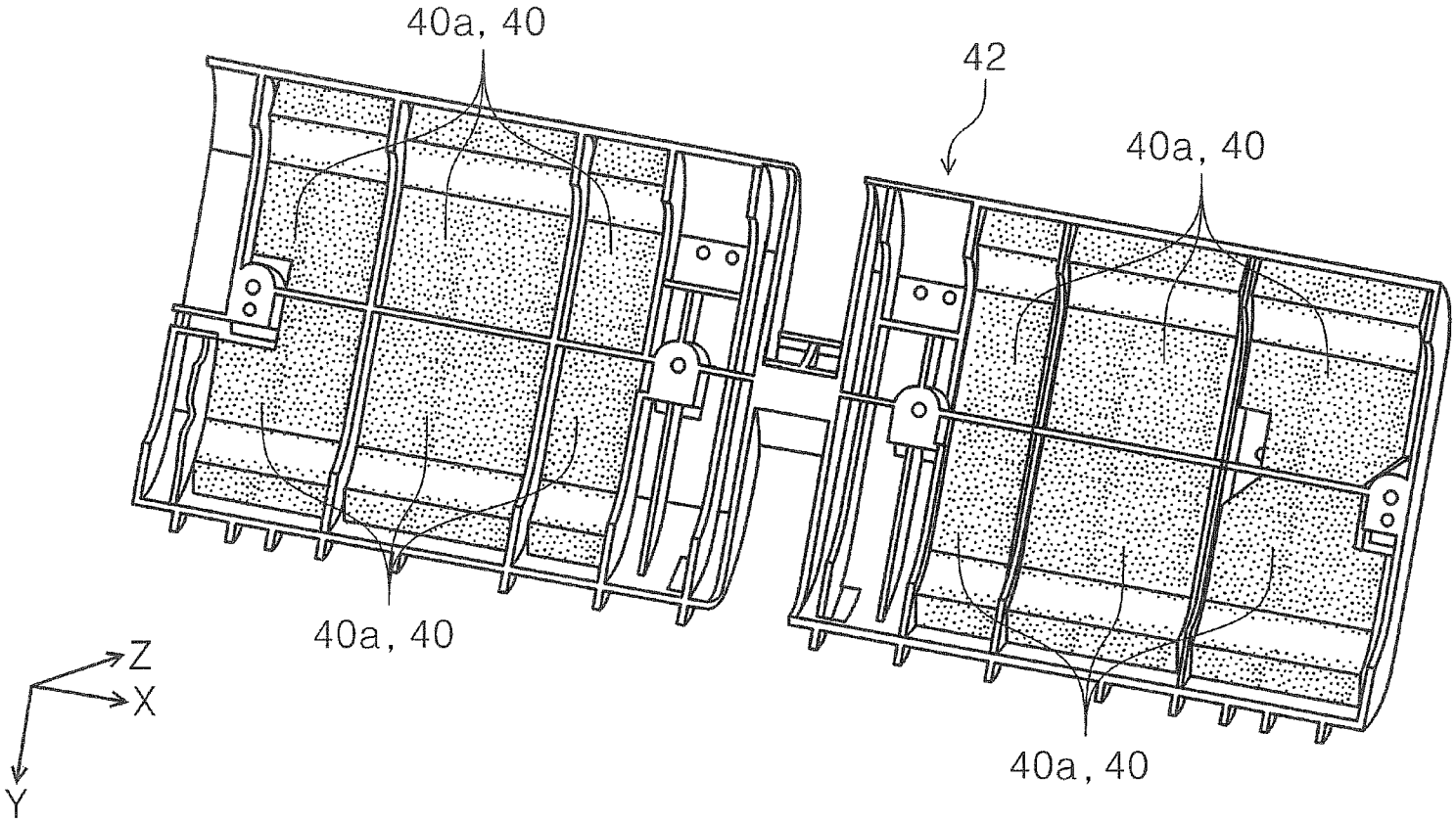
FIG. 9 is a perspective view illustrating a unit-body upper member.
Figure 10:
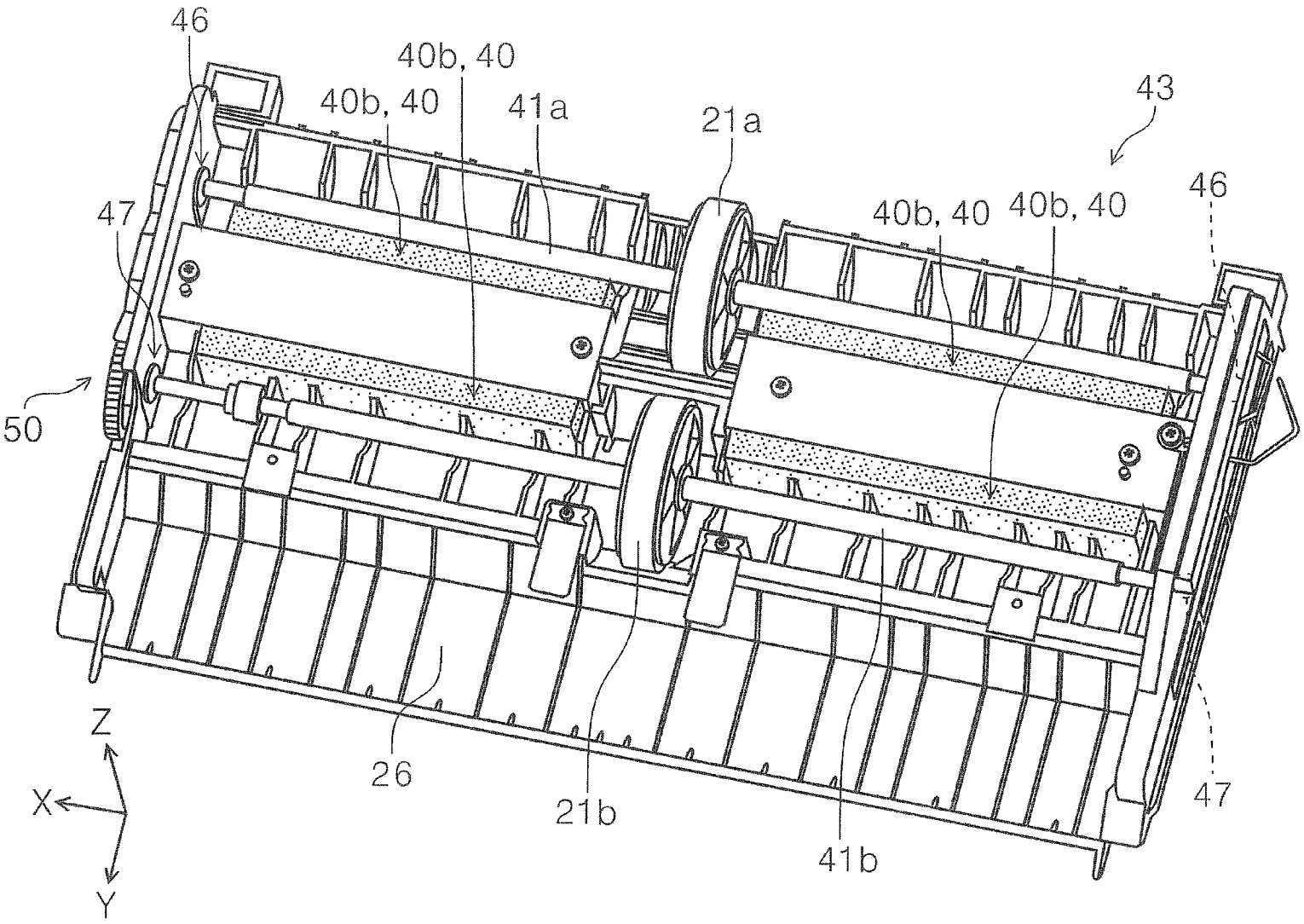
FIG. 10 is a perspective view illustrating a unit-body lower member.
Figure 11:
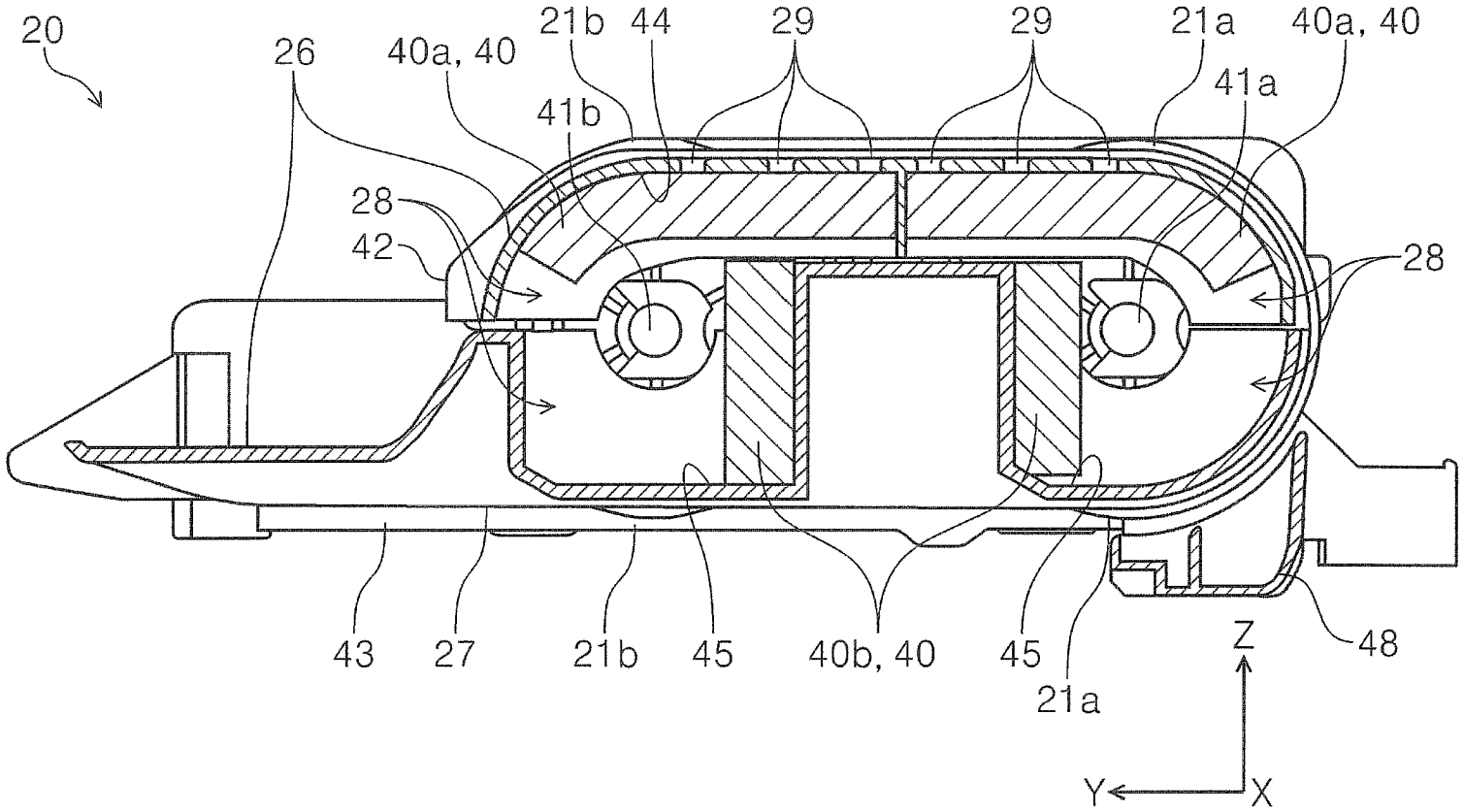
FIG. 11 is a cross-sectional side view illustrating the unit body.
Figure 12:
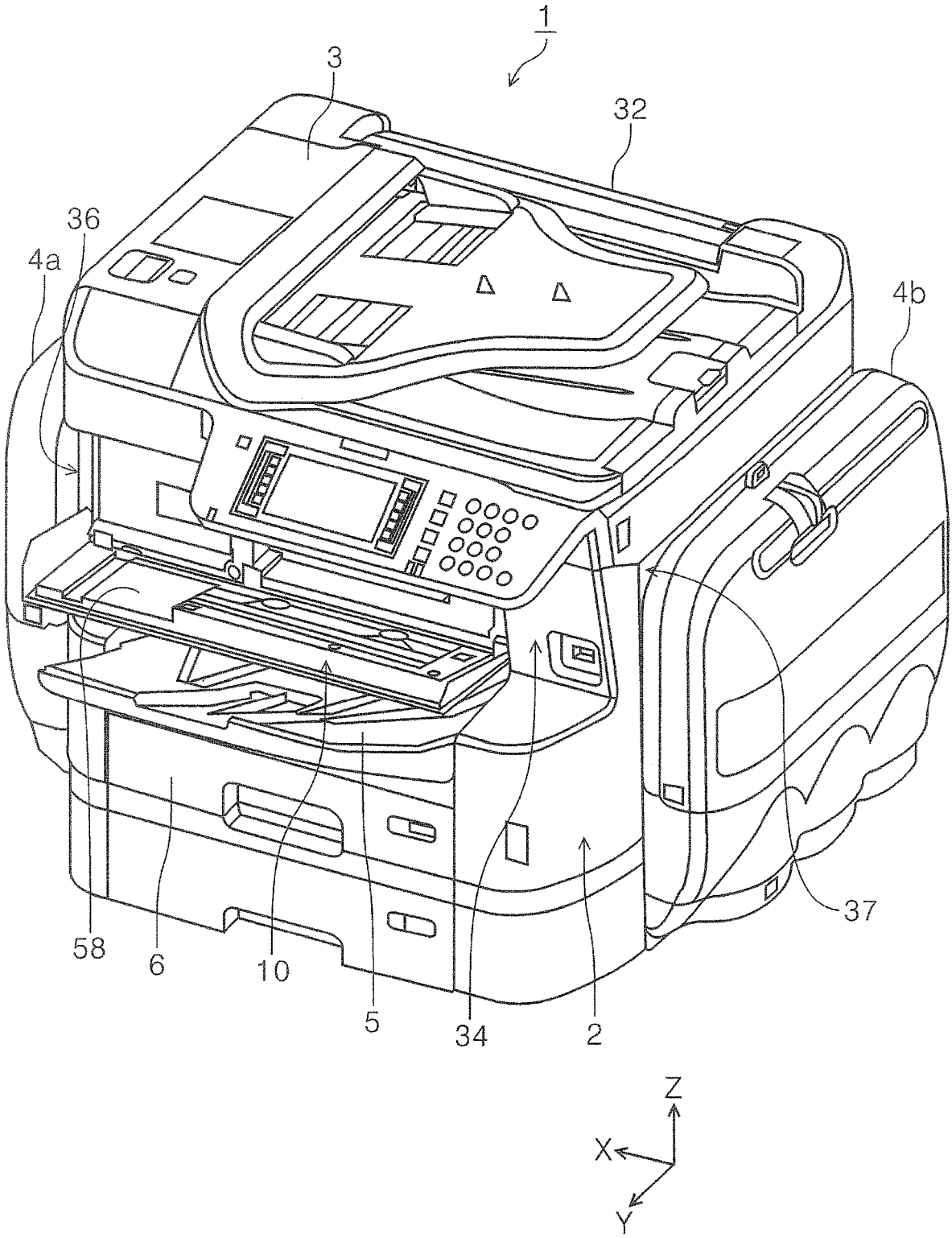
FIG. 12 is a view illustrating a state in which a front-side cover of the printer in FIG. 1 is open.

FIG. 7 is a perspective view illustrating the exterior of a unit body. FIG. 8 is a perspective view illustrating the unit body in FIG. 7 when viewed from a different angle. FIG. 9 is a perspective view illustrating a unit-body upper member. FIG. 10 is a perspective view illustrating a unit-body lower member. FIG. 11 is a cross-sectional side view illustrating the unit body. FIG. 12 is a view illustrating a state in which a front-side cover of the printer in FIG. 1 is open.

Note that in the X-Y-Z coordinate system indicated in each drawing, the X-axis direction represents the width direction of the recording apparatus and the moving direction of the recording head, the Y-axis direction represents the depth direction of the recording apparatus, and the Z-axis direction represents the height direction of the recording apparatus. Also note that in each drawing, the +X direction is the direction toward the left of the apparatus and the −X direction is the direction toward the right of the apparatus. The +Y direction is the direction toward the front of the apparatus and the −Y direction is the direction toward the rear of the apparatus. The +Z direction is the direction toward the top of the apparatus and the −Z direction is the direction toward the bottom of the apparatus. The direction in which sheets of paper are transported in the printer is referred to as "downstream" and the opposite direction is referred to as "upstream".

Overall Structure of Printer

The overall structure of a printer 1 will be outlined with reference mainly to FIG. 1. The printer 1 (FIG. 1) according to the disclosure includes an apparatus body 2 having a recording head 7, which serves as a recording device, for performing recording by ejecting ink onto a sheet of paper, which serves as a medium. The printer 1 also includes a scanner 3 that is disposed in an upper section of the apparatus body 2. In other words, the printer 1 is formed as a multifunction printer having a recording function and a scanner function. Outside the apparatus body 2, the printer 1 also includes ink container accommodation cases 4*a*, 4*b* that accommodate ink containers (not shown) for containing ink that is supplied to the recording head 7.

Inside the apparatus body 2, the recording head 7 is mounted in a carriage 8 that is formed so as to be able to move in the X-axis direction in FIG. 1. The recording head 7 is formed to perform recording by ejecting ink onto a sheet that is transported to a recording region K (FIG. 3) that opposes the recording head 7.

Sheet Transport Path of Printer.

Next, a transport path P for sheets (medium transport path) in the printer 1 will be described with reference mainly to FIGS. 3 and 4. The printer 1 is formed so as to be able to perform duplex printing for recording on both sides (i.e., front and back sides) of a sheet. Thus, the transport path P includes a feed path Q (indicated by the dash-dot line in FIGS. 3 and 4) and a switchback path R (indicated by the dotted line in FIGS. 3 and 4) that joins the feed path Q. On the feed path Q, a sheet is transported from a sheet cassette 6, which will be described below, toward a recording region K where the recording head 7 performs recording. The sheet on which recording has been performed is switched back from the recording region K and inverted on the switchback path R and is subsequently transported to the feed path Q. Note that in FIG. 3, reference symbol G denotes stacked sheets G in which a plurality of sheets of paper are stacked. Following, the feed path Q will be described first, followed by description of the switchback path R.

Feed Path

The sheet cassette 6 (see also in FIG. 1), which serves as a setting device for setting a plurality of sheets of paper, is provided in a lower section of the apparatus body 2. Reference 6*a* denotes an accommodating portion for accommodating sheets of paper. As illustrated in FIG. 3, the topmost sheet of a plurality of sheets (stacked sheets G) that have been set in the sheet cassette 6 is picked up from the sheet cassette 6 by a first feed roller 12 (otherwise referred to as "a pickup roller"). The sheet is subsequently nipped by a transport driving roller 13 and a separation roller 14 and sent downstream in the transport path. The transport driving roller 13 is rotationally driven by a driving source (not shown) so as to transport the sheet, and the separation roller 14 is rotated by following the rotation of the transport driving roller 13.

The apparatus body 2 has a rear-side cover 11 (FIGS. 5 and 6). The rear-side cover 11 is an opening/closing body that opens/closes an accommodation space (space inside the apparatus body 2) for accommodating a unit body 20 (FIGS. 2 and 7), which will be described in detail below. While the opening/closing body is closed with respect to the apparatus body 2 (see also FIG. 5), the opening/closing body constitutes part of the feed path Q for sheets as illustrated in FIG. 3 and also part of the exterior of the apparatus body 2 as illustrated in FIG. 5. In addition, as illustrated in FIG. 6, the rear-side cover 11 is formed to be openable for the maintenance of the feed path Q (such as removing a jammed sheet).

The unit body 20 (FIGS. 2 and 7) is disposed at a position in the apparatus opposing the rear-side cover 11. At least a portion of the periphery of the unit body 20 is formed as a path-forming surface that forms part of the transport path P (at least one of the feed path Q and the switchback path R). More specifically, the extent of the periphery that is indicated by the dash-dot and double-pointed arrow A in FIG. 4 is formed as a first path-forming surface 26 that serves as a lower guide surface of the feed path Q. In addition, the extent of the periphery that is indicated by the dotted and double-pointed arrow B in FIG. 4 is formed as a second path-forming surface 27 that serves as an upper guide surface of the switchback path R.

The unit body 20 is detachably mounted in the apparatus body 2. The unit body 20 (FIGS. 3 and 4) includes transport driving rollers 21*a* and 21*b*, both of which serve as unit body-side transport rollers constituting transport devices disposed on the transport path P for transporting sheets. Transport idler rollers 18*a*, 18*b*, 18*c*, and 18*d* (see FIG. 4 as well as FIG. 3), which serve as apparatus-side transport rollers, are disposed at positions opposing the first path-forming surface 26 (FIG. 4) in the apparatus body 2. The transport idler rollers 18*a* and 18*b*, which are rotated by following the rotation of the transport driving roller 21*a*, nip a sheet with the transport driving roller 21*a* for transporting the sheet. In addition, the transport idler rollers 18*c* and 18*d*, which are rotated by following the rotation of the transport driving roller 21*b*, nip a sheet with the transport driving roller 21*b* for transporting the sheet. Note that in the embodiment, two transport idler rollers 18*a* and 18*b* are provided for one transport driving roller 21*a* on the feed path Q. However, the number of the transport idler rollers is not limited to two but may be one or more than two. The same applies to the transport driving roller 21*b*.

In the unit body 20, as illustrated in FIG. 4, the transport driving rollers 21*a* and 21*b* have respective rotating shafts 41*a* and 41*b* inside the unit body 20. Part of the respective roller surfaces of the transport driving rollers 21*a* and 21*b* are exposed on the first path-forming surface 26.

In the embodiment, the transport driving rollers 21*a* and 21*b* of the unit body 20 are each rotationally driven in the clockwise direction in FIG. 4 by a common driving source (not shown) via a power transmission mechanism 50 disposed in the unit body 20 (see FIG. 8). The unit body 20 and the power transmission mechanism 50 will be described in detail below.

The feed path Q is formed in a curved manner such as to follow the shape of the roller surface of the transport driving roller 21*a* of the unit body 20. A sheet that has been transported from the sheet cassette 6 toward the rear side of the apparatus (−Y direction) is thereby transported toward the front side of the apparatus (+Y direction) by the transport driving roller 21*a*.

A transport roller pair 15 is disposed on the upstream side (i.e., the side near the rear side of the apparatus or the side in the −Y direction) of the recording head 7. The sheet is subsequently transported to below the recording head 7 by the transport roller pair 15. The sheet transported toward the front side of the apparatus passes under the recording head 7 while being supported by a support member 16 that is disposed opposing the recording head 7. The recording head 7 ejects ink onto the sheet to perform recording. Discharge roller pairs 17*a* and 17*b*, which serve as discharge devices, are disposed on the downstream side (i.e., the side near the front side of the apparatus or the side in the +Y direction) of the recording head 7. The sheet on which recording has been performed is discharged by the discharge roller pairs 17*a* and 17*b* into a discharge tray 5 disposed on the front side of the apparatus.

Switchback Path

Next, the switchback path R will be described with reference to FIG. 4. When recording is performed onto both sides of a sheet in the printer 1, the recording head 7 first performs recording on a first side (front side) of the sheet. The sheet is subsequently sent to the switchback path R that is located under the unit body 20 by a reverse feed action of the transport roller pair 15 and the discharge roller pairs 17*a* and 17*b*. The reverse feed action causes the edge of the sheet that is the trailing edge of the sheet when recording is performed on the first side to become the leading edge. The switchback path R is located downward (in the −Z direction) of the transport driving rollers 21*a* and 21*b*.

In the switchback path R (see FIG. 4), the lower portion of the periphery of the unit body 20 (in FIG. 4, the extent of the periphery indicated by the dotted and double-pointed arrow B) is formed as the second path-forming surface 27 that serves as the upper guide surface of the switchback path R. The switchback path R is disposed so as to join the feed path Q for sheet transport at a first junction point M.

The sheet transported from the recording region K on the switchback path R in the reverse direction enters the feed path Q at the first junction point M. The sheet is transported again to the recording region K, in which the recording head 7 performs recording on the second side (back side). After recording is completed, the sheet is nipped by the discharge roller pairs 17*a* and 17*b* and discharged into the discharge tray 5.

In the unit body 20, the transport driving roller 21*b* is formed so as to nip the sheet with the transport idler roller 18*e*, which serves as an apparatus-side transport roller. The transport idler roller 18*e* is disposed at a position in the apparatus body 2 opposing the second path-forming surface 27 (FIG. 4). The transport driving rollers 21*a* and 21*b* are exposed on the second path-forming surface 27 that constitutes part of the switchback path R. Thus, the transport driving rollers 21*a* and 21*b* also carry out a function of transporting the sheet in the switchback path R.

The transport driving rollers 21*a* and 21*b*, which are exposed on both the first path-forming surface 26 and the second path-forming surface 27, contribute to sheet transport on both the feed path Q and the switchback path R. As a result, the number of parts can be reduced, which leads to the size reduction of the unit body 20 and thus to the size reduction of the printer 1. Note that in the embodiment, one transport idler roller 18*e* is provided for the transport driving roller 21*b* on the switchback path R. However, the number of the transport idler rollers 18*e* is not limited to one but may be two or more. Also note that in the embodiment, no transport idler roller, which serves as the apparatus-side transport roller, is provided for the transport driving roller 21*a* at a position in the apparatus body 2 opposing the second path-forming surface 27. However, it is possible to provide a transport idler roller for the transport driving roller 21*a*.

Sheet Transport from Manual Feeder Tray

The printer 1 is formed such that a manual feeder tray 31 (FIG. 3) can be used for feeding sheets of paper. Reference 32 at the upper rear corner of the apparatus body 2 illustrated in FIG. 2 denotes a manual feeder cover 32 (see also FIG. 5) that can open/close a sheet setting opening 30. Sheets of paper can be set in the manual feeder tray 31 by opening the manual feeder cover 32.

The topmost sheet of the sheets set into the manual feeder tray 31 from the sheet setting opening 30 is picked up by a second feed roller 19 and sent downstream, along a path indicated by the dash-dot-dot line S in FIGS. 3 and 4, into the feed path Q at a second junction point N illustrated in FIGS. 3 and 4. The sheet is thus transported to the recording region K where the recording head 7 performs recording.

Unit Body

Next, the structure of the above unit body 20 will be further described with reference to the FIGS. 3 to 11. As illustrated in FIG. 11, the unit body 20 has an interior space 28 and a plurality of through holes 29 (see also FIG. 7) at least on a portion of the first path-forming surface 26. The through holes 29 are in communication with the interior space 28. The unit body 20 also has sound absorbers 40 (first sound absorbers 40*a* and second sound absorbers 40*b* to be described below) disposed in the interior space 28 (see FIG. 11).

The unit body 20 is constituted by a unit-body upper member 42 illustrated in FIG. 9 and a unit-body lower member 43 illustrated in FIG. 10. The unit-body lower member 43 has bearings 46 and bearings 47 (FIG. 10). As illustrated in FIG. 10, a rotating shaft 41*a* of the transport driving roller 21*a* is rotatably attached to the bearings 46, and a rotating shaft 41*b* of the transport driving roller 21*b* is rotatably attached to the bearings 47.

As illustrated in FIGS. 7 and 11, a plurality of through holes 29 are disposed in the unit-body upper member 42. As illustrated in FIG. 9, the first sound absorbers 40*a* are also disposed on an interior wall 44 (FIG. 11) of the unit-body upper member 42, the interior wall 44 corresponding to the first path-forming surface 26 (FIG. 11) of the unit body 20. Moreover, as illustrated in FIG. 10, the second sound absorbers 40*b* are disposed at positions on an interior wall 45 (FIG. 11) of the unit-body lower member 43, the interior wall 45 forming the back side of the second path-forming surface 27 (FIG. 11) of the unit body 20. In the unit-body upper member 42, a plurality of through holes 29 are covered with the first sound absorbers 40*a* from inside the unit body 20 (FIGS. 9, 11).

The unit body 20 is surrounded by transport paths P (the feed path Q and the switchback path R) as illustrated in FIG. 4. The unit body 20 surrounded by the transport paths P has the sound absorbers 40 provided in the interior space 28, and a plurality of through holes 29 that are in communication with the interior space 28 are provided in the unit-body upper member 42, which forms the periphery of the unit body 20. With this configuration, the sound absorbers 40 can absorb sound generated around the unit body 20. This enables the apparatus body 2 to reduce the sound escaping therefrom.

In particular, as illustrated in FIGS. 9 and 11, covering the through holes 29 with the first sound absorbers 40*a* from inside the unit body 20 enables the first sound absorbers 40*a* to absorb sound even more efficiently.

All of the through holes 29 are not necessarily covered with the first sound absorbers 40*a*. However, even in the case that the through holes 29 are not covered with the first sound absorbers 40*a*, it is preferable that the first sound absorbers 40*a* be disposed at positions corresponding to the positions at which the through holes 29 are formed. For example, the first sound absorbers 40*a* may be provided at a distance from the through holes 29, in other words, at positions that can be seen through the through holes 29 from outside the unit body 20.

It is preferable that as in the embodiment, the through holes 29 provided in the unit body 20 be disposed at least on the first path-forming surface 26. When a sheet is transported on the transport path P such as the feed path Q or the switchback path R, the transported sheet rubs against structures of each path and may make a rustling sound. Such a rustling sound tends to occur during transport of a dry sheet before recording.

Thus, by providing the through holes 29 on the first path-forming surface 26 that forms the feed path Q on which dry sheets before recording can be transported, the rustling sound that tends to occur on the feed path Q can be efficiently reduced.

Moreover, the unit body 20 has the first sound absorbers 40*a* disposed on the interior wall 44 that is the back side of the first path-forming surface 26, which serves as the feed path Q. The unit body 20 also has the second sound absorbers 40*b* disposed on the interior wall 45 that is the back side of the second path-forming surface 27, which serves as the switchback path R. As a result, the rustling sound of the sheet can be reduced when the sheet is transported on the feed path Q or on the switchback path R. Note that in the embodiment, the second sound absorbers 40*b* extend in the X-axis direction along the rotating shaft 41*a* of the transport driving roller 21*a* and along the rotating shaft 41*b* of the transport driving roller 21*b* (FIG. 10). In the Z-axis direction, the second sound absorbers 40*b* extend vertically from portions of the interior wall 45 that correspond to the position of the second path-forming surface 27 to positions to the sides of the rotating shafts 41*a* and 41*b*. Disposing the second sound absorbers 40*b* in such a manner enables the second sound absorbers 40*b* to absorb the sound generated in conjunction with the rotation of the rotating shaft 41*a* and the rotating shaft 41*b*.

In addition, in the unit body 20 according to the embodiment, the through holes 29 are disposed mainly in a region in the −Y direction of the first path-forming surface 26 (FIGS. 7 and 11). The apparatus body 2 of the printer 1 has a sheet setting opening 30 (FIGS. 2 and 3) above the rear side (the side in the −Y direction) of the unit body 20. The sheet setting opening 30 serves as an insertion device capable of inserting a medium into a path region on the first path-forming surface 26 on the feed path Q. Sound tends to escape from the inside of the apparatus body 2 through the sheet setting opening 30 that opens to the outside of the apparatus body 2.

As in the embodiment, the through holes 29 on the first path-forming surface 26 in the unit body 20 are provided at least at positions near the sheet setting opening 30. This can efficiently reduce the sound escaping from the sheet setting opening 30 when a sheet is fed from the manual feeder tray 31.

Note that in the unit body 20 according to the embodiment, the through holes 29 are provided only on the first path-forming surface 26 but the through holes 29 may be provided also for the second path-forming surface 27. Providing the through holes 29 on the second path-forming surface 27 that forms the switchback path R can reduce the rustling sound generated by the sheet transported on the switchback path R.

The bearings 46 that support the rotating shaft 41*a* of the transport driving roller 21*a* and the bearings 47 that support the rotating shaft 41*b* of the transport driving roller 21*b* are disposed in the unit-body lower member 43 as is previously described, and the bearings 46 and 47 are located inside the unit body 20. In the unit body 20, the through holes 29 are disposed at positions away from the positions that correspond to the bearings 46 and 47 on the first and second path-forming surface 26 and 27. As illustrated in FIG. 7, in the embodiment, the through holes 29, which are only provided on the first path-forming surface 26, are not provided at positions that correspond to the bearings 46 and 47 on the first path-forming surface 26.

The bearings 46 and 47 may produce sliding sound in conjunction with the rotation of the corresponding rotating shafts 41*a* and 41*b*. Eliminating the through holes 29 from the positions that correspond to the bearings 46 and 47 on the first path-forming surface 26 reduces the likelihood of the sliding sound of the bearings 46 and 47 escaping from the unit body 20 and enables the sound absorbers 40 provided inside the unit body 20 to absorb the sliding sound.

The unit body 20 (more specifically, the unit-body lower member 43) illustrated in FIG. 8 has a path-forming member 48 (see also FIG. 11) disposed therein at a position closer to the rear of the apparatus (in the −Y direction). The path-forming member 48, which faces a portion of the second path-forming surface 27, forms a path that continues to the first junction point M (FIG. 4) at which the path joins the feed path Q.

Other Mechanism of Unit Body

Next, a power transmission mechanism 50 will be described. The power transmission mechanism 50 transmits power from the driving source (not shown) disposed in the apparatus body 2 to the transport driving rollers 21*a* and 21*b*. As illustrated in FIG. 8, the power transmission mechanism 50 is disposed on the side of the unit body 20 in the +X direction and constituted by a plurality of gears. The power transmission mechanism 50 includes a driving gear 51, an intermediate gear 52, and a driving gear 53.

The driving gear 51 is connected to the transport driving roller 21*a* via the rotating shaft 41*a*, and the driving gear 53 is connected to the transport driving roller 21*b* via the rotating shaft 41*b*. The intermediate gear 52 are disposed between the driving gear 51 and the driving gear 53 in such a manner that the rotation of one of the driving gears (for example, the driving gear 53) causes the other gear (the driving gear 51) to rotate. In the embodiment, the driving source (not shown) provides the driving gear 53 with a driving force, which cause the driving gear 53 to rotate clockwise in FIG. 8. Subsequently, the intermediate gear 52 that engages the driving gear 53 is caused to rotate counterclockwise in FIG. 8, which causes the driving gear 51 that engages the intermediate gear 52 to rotate clockwise in FIG. 8. Thus, the driving gear 51 and the driving gear 53 both rotate clockwise in FIG. 8.

Other Sound Absorbers Provided in Printer

The housing of the printer 1, which is the apparatus body 2, stands in the Z-axis direction that intersects the medium transport direction (the Y-axis direction). In this orientation, the exterior of the apparatus body 2 is constituted by an apparatus front side 34 (FIGS. 1 and 2), an apparatus rear side 35 (FIG. 2), a left side 36 (FIG. 1), and a right side 37 (FIG. 1).

An opening/closing-body sound absorber 55 (FIG. 2) is disposed along at least a portion of the apparatus rear side 35. In the embodiment, the opening/closing-body sound absorber 55 is disposed on the back side (the side in the −Y direction) of the path-forming wall 56, which forms part of the feed path Q, of the rear-side cover 11, which is part of the apparatus rear side 35. More specifically, the opening/closing-body sound absorber 55 is disposed inside the rear-side cover 11 that is formed hollow. Note that the path-forming wall 56 is formed so as to have a continuous surface without openings. In other words, the path-forming wall 56 does not have such openings as the through holes 29 of the unit body 20, and thus the opening/closing-body sound absorber 55 cannot be seen from a position inside the apparatus body 2.

Providing the path-forming wall 56 with openings causes the opening/closing-body sound absorber 55 to obtain a sound absorption effect more easily but at the same time, tends to cause the internal sound to escape from the apparatus body 2 through the through holes because the opening/closing-body sound absorber 55 is disposed in the apparatus body 2 at a position close to the outside. In the embodiment, the path-forming wall 56 has a continuous surface without openings. This enables the opening/closing-body sound absorber 55 to absorb the sound generated inside the apparatus body 2 while reducing the sound escaping from the apparatus body 2. Note that the "openings" that are not provided on the path-forming wall 56 mean apertures for the purpose of improving the sound absorption effect of the opening/closing-body sound absorber 55. Thus, apertures for other purposes (for example, screw holes, etc.) can be provided on path-forming wall 56.

In addition, a front-side cover 10 (FIG. 1, FIG. 12) is disposed on the front side (the side in the +Y direction) of the apparatus body 2. The front-side cover 10 constitutes part of the apparatus front side 34. The front-side cover 10 is located above a discharge opening 9 from which sheets are discharged. As illustrated in FIG. 12, the front-side cover 10 can be turned open about a pivot at its bottom portion. Maintenance and other operations inside the apparatus body 2 can be performed while the front-side cover 10 is open.

A front-side sound absorber 57 is disposed along the inside of the front-side cover 10. The front-side cover 10 is formed hollow, and the front-side sound absorber 57 is disposed inside the front-side cover 10. As illustrated in FIG. 12, an interior wall portion 58, which is the inward-facing surface of the front-side cover 10, does not have openings for the purpose of improving the sound absorption effect. On the front side of the apparatus, the sound generated inside the apparatus body 2 tends to escape from the discharge opening 9 that is in communication with the inside of the apparatus body 2. Providing the front-side sound absorber 57 above the discharge opening 9 effectively reduces noise escaping from the apparatus front side.

Note that the sound absorbers described above can be formed of a material having sound absorbing properties, such as, for example, polyurethane foam, sponges, nonwoven fabric, glass wool, synthetic fiber, or natural wool.

Note that the disclosure is not limited to the embodiment described above and various modifications can be made within the scope of the disclosure set forth in the claims. Thus, all such modifications are intended to be included within the scope of this disclosure.

What is claimed is:

1. A recording apparatus, comprising:

an apparatus body including a recording device that performs recording onto a medium;

a unit body that is accommodated inside the apparatus body and includes a path-forming surface formed at least on a portion of a periphery of the unit body, the path-forming surface forming a medium transport path, the unit body having an inner side and an outer side, the inner side being a side that is closer to a center of the apparatus body, the outer side being a side that is closer to an outer surface of the apparatus body, and the path-forming surface being formed on the outer side of the unit body; and a sound absorber disposed on the inner side of the unit body, wherein the unit body includes a plurality of openings that are in communication with the sound absorber disposed inside the unit body, the plurality of the openings being provided at least on a portion of the path-forming surface, wherein:

the unit body houses a unit body-side transport roller, the unit body-side transport roller is a driving roller, the unit body-side transport roller and an idler roller form a roller pair configured to transport the medium, and the idler roller is disposed outside the unit body.

2. The recording apparatus according to claim 1, wherein the sound absorber is disposed at a position inside the unit body corresponding to positions at which the openings are formed.

3. The recording apparatus according to claim 2, wherein the openings are covered with the sound absorber from inside the unit body.

4. The recording apparatus according to claim 1, wherein the path-forming surface includes a first path-forming surface that forms a feed path on which the medium is transported from a setting device at which the medium is set toward a recording region of the recording device and a second path-forming surface that forms a switchback path on which, when the medium onto which the recording device has performed recording is inverted, the medium is switched back from the recording region and transported into the feed path, and the openings are disposed at least on the first path-forming surface.

5. The recording apparatus according to claim 4, wherein the apparatus body includes an insertion device capable of inserting the medium into a path region on the first path-forming surface on the feed path, the insertion device being different from the setting device, and the openings are at least disposed at positions near the insertion device on the first path-forming surface.

6. The recording apparatus according to claim 4, wherein the sound absorber is disposed on a back side of the second path-forming surface.

7. The recording apparatus according to claim 4, wherein the openings are disposed on both the first path-forming surface and the second path-forming surface.

8. A recording apparatus, comprising:

an apparatus body including a recording device that performs recording onto a medium;

a unit body that is accommodated inside the apparatus body and includes a path-forming surface formed at least on a portion of a periphery of the unit body, the path-forming surface forming a medium transport path, the unit body having an inner side and an outer side, the inner side being a side that is closer to a center of the apparatus body, the outer side being a side that is closer to an outer surface of the apparatus body, and the path-forming surface being formed on the outer side of the unit body;

a sound absorber disposed on the inner side of the unit body, wherein the unit body includes a plurality of openings that are in communication with the sound absorber disposed inside the unit body, the plurality of the openings being provided at least on a portion of the path-forming surface; and transport devices that are provided in the medium transport path and that transport the medium, wherein at least one of the transport devices is formed so as to have an apparatus-side transport roller disposed at a position facing the unit body within the apparatus body and a unit body-side transport roller disposed in the unit body, the unit body has a bearing therein that supports a rotating shaft of the unit body-side transport roller, and the openings are disposed at positions away from a position at which the bearing is disposed in a direction in which the rotating shaft extends, wherein:

the path-forming surface includes a first path-forming surface that forms a feed path on which the medium is transported from a setting device at which the medium is set toward a recording region of the recording device and a second path-forming surface that forms a switchback path on which, when the medium onto which the recording device has performed recording is inverted, the medium is switched back from the recording region and transported into the feed path, and the openings are disposed at least on the first path-forming surface, the unit body houses the unit body-side transport roller, the apparatus-side transport roller is disposed outside the unit body, the unit body-side transport roller is a driving roller, the apparatus-side transport roller is an idler roller, and the unit body-side transport roller and the apparatus-side transport roller form a roller pair configured to transport the medium.

9. The recording apparatus according to claim 8, wherein the unit body-side transport roller is exposed on both the feed path and the switchback path.

10. A recording apparatus, comprising:

an apparatus body including a recording device that performs recording onto a medium;

a unit body that is accommodated inside the apparatus body and includes a path-forming surface formed at least on a portion of a periphery of the unit body, the path-forming surface forming a medium transport path; and a sound absorber disposed on an inside portion of an outer covering of the unit body, wherein the unit body includes a plurality of openings that are in communication with the sound absorber disposed inside the unit body, the plurality of the openings being provided at least on a portion of the path-forming surface, wherein the path-forming surface includes a first path-forming surface that forms a feed path on which the medium is transported from a setting device at which the medium is set toward a recording region of the recording device and a second path-forming surface that forms a switchback path on which, when the medium onto which the recording device has performed recording is inverted, the medium is switched back from the recording region and transported into the feed path, and the openings are disposed at least on the first path-forming surface, and wherein the unit body is capable of being attached to, and detached from, the apparatus body, the apparatus body includes an opening/closing body that opens/closes an accommodation space in which the unit body is accommodated, the opening/closing body having a path-forming wall and forming, in a closed state of the opening/closing body, a portion of a feed path on the path-forming wall and a portion of an exterior of the apparatus body, the apparatus body further includes an opening/closing-body sound absorber disposed on a back side of the path-forming wall, and the path-forming wall is formed so as to have a continuous surface without openings.

11. A recording apparatus, comprising:

an apparatus body including a recording device that performs recording onto a medium;

a unit body that is accommodated inside the apparatus body and includes a path-forming surface formed at least on a portion of a periphery of the unit body, the path-forming surface forming a medium transport path, the unit body having an inner side and an outer side, the inner side being a side that is closer to a center of the apparatus body, the outer side being a side that is closer to an outer surface of the apparatus body, and the path-forming surface being formed on the outer side of the unit body;

a sound absorber disposed on the inner side of the unit body, wherein the unit body includes a plurality of openings that are in communication with the sound absorber disposed inside the unit body, the plurality of the openings being provided at least on a portion of the path-forming surface, and transport devices that are provided in the medium transport path and that transport the medium, wherein at least one of the transport devices is formed so as to have an apparatus-side transport roller disposed at a position facing the unit body within the apparatus body and a unit body-side transport roller disposed in the unit body, the unit body including a bearing therein that supports a rotating shaft of the unit body-side transport roller, and the openings are disposed at positions away from a position at which the bearing is disposed in a direction in which the rotating shaft extends, wherein:

the unit body houses the unit body-side transport roller, the apparatus-side transport roller is disposed outside the unit body, the unit body-side transport roller is a driving roller, the apparatus-side transport roller is an idler roller, and the unit body-side transport roller and the apparatus-side transport roller form a roller pair configured to transport the medium.

12. A recording apparatus, comprising:

an apparatus body including a recording device that performs recording onto a medium;

a unit body that is accommodated inside the apparatus body and includes a path-forming surface formed at least on a portion of a periphery of the unit body, the path-forming surface forming a medium transport path; and a sound absorber disposed inside the unit body, wherein the unit body includes a plurality of openings that are in communication with the sound absorber disposed inside the unit body, the plurality of the openings being provided at least on a portion of the path-forming surface;

wherein the unit body is capable of being attached to, and detached from, the apparatus body, the apparatus body includes an opening/closing body that opens/closes an accommodation space in which the unit body is accommodated, the opening/closing body having a path-forming wall and forming, in a closed state of the opening/closing body, a portion of a feed path on the path-forming wall and a portion of an exterior of the apparatus body, the apparatus body further includes an opening/closing-body sound absorber disposed on a back side of the path-forming wall, and the path-forming wall is formed so as to have a continuous surface without openings.

* * * * *